US008695836B1

(12) United States Patent
Gregory

(10) Patent No.: US 8,695,836 B1
(45) Date of Patent: Apr. 15, 2014

(54) BEVERAGE CONTAINER ASSEMBLY AND CAP

(76) Inventor: Marteniz Gregory, Redford, MI (US)

( * ) Notice: Subject to any disclaimer, the term of this patent is extended or adjusted under 35 U.S.C. 154(b) by 0 days.

(21) Appl. No.: 13/474,700

(22) Filed: May 17, 2012

Related U.S. Application Data

(60) Provisional application No. 61/519,139, filed on May 17, 2011.

(51) Int. Cl.
*B65D 85/72* (2006.01)

(52) U.S. Cl.
USPC ..... 220/524; 220/553; 215/387

(58) Field of Classification Search
USPC ..... 220/553, 524; 215/6, 387, 396
See application file for complete search history.

(56) References Cited

U.S. PATENT DOCUMENTS

| | | | | | |
|---|---|---|---|---|---|
| 3,347,420 | A | * | 10/1967 | Donoghue | 222/129 |
| 3,467,269 | A | | 9/1969 | Newton | |
| 4,702,473 | A | | 10/1987 | Paquette | |
| 4,955,503 | A | * | 9/1990 | Propes | 220/526 |
| 5,143,261 | A | * | 9/1992 | Drobish | 222/129 |
| D337,522 | S | * | 7/1993 | Kingsbury | D9/538 |
| 5,316,159 | A | * | 5/1994 | Douglas et al. | 215/10 |
| 5,573,143 | A | | 11/1996 | Deardurff et al. | |
| 6,063,223 | A | * | 5/2000 | Klauke et al. | 156/242 |
| 6,237,800 | B1 | | 5/2001 | Barrett | |
| 6,454,129 | B1 | * | 9/2002 | Green | 222/94 |
| 6,499,614 | B1 | | 12/2002 | Thompson | |
| D544,353 | S | * | 6/2007 | Dodd | D9/516 |
| D585,277 | S | * | 1/2009 | Beauplan | D9/449 |
| D596,492 | S | | 7/2009 | Safadein | |
| 7,611,028 | B2 | * | 11/2009 | Desico et al. | 215/398 |
| D614,046 | S | * | 4/2010 | Piro | D9/743 |
| D628,085 | S | | 11/2010 | Hanak | |
| 7,975,868 | B1 | * | 7/2011 | Flies et al. | 220/524 |
| 2008/0000866 | A1 | | 1/2008 | Yates, III | |
| 2010/0237034 | A1 | | 9/2010 | Kountotsis | |

* cited by examiner

*Primary Examiner* — Steven A. Reynolds
*Assistant Examiner* — Ernesto Grano
(74) *Attorney, Agent, or Firm* — Singh Law Firm, PLLC; Gautam B. Singh

(57) ABSTRACT

A beverage container comprising of multiple compartments and a cap to dispense beverages independently from the multiple compartments is disclosed. The invention enables the use of a beverage container, such as a single bottle, for carrying a plurality of beverages within its multiple compartments. The disclosed design of a split cap includes a plurality of valves that enable it in selectively dispensing contents of each compartment. The user may choose to consume one or more of beverages stored from the disclosed beverage container. A container and cap assembly built with pressure withstanding material allows consumer to enjoy a plurality of pressurized beverages, such as multiple types of soda, from a single bottle.

20 Claims, 6 Drawing Sheets

BEVERAGE CONTAINER ASSEMBLY AND CAP

CROSS REFERENCE TO RELATED APPLICATIONS

The application claims the benefits of provisional patent application Ser. No. 61/519,139, filed on May 17, 2011, by the present inventor which is incorporated herewith by reference.

BACKGROUND OF THE INVENTION

1. Field of Invention

This invention relates to the field of beverage containers. The container includes at least two chambers designed to hold two completely different beverages. The container is attached to a cap which has a split spout adapted for the independent and selective consumption of individual beverages.

2. Prior Art

Bottled beverages and bottled water have become increasingly popular over the past few decades. Our society is also becoming more conscious of a healthy lifestyle where consumers want to drink water and sports drinks and keep the consumption of high calorie sodas and drinks within limits. There is therefore a need to carry and consume water for health reasons as well as sodas for personal enjoyment and taste. Currently, this need is fulfilled by the users having to carry multiple bottles on their person.

Inventions disclosed in the prior art do not provide for a cap attached to the beverage container wherein the cap is adapted to consume beverages selectively or concurrently if the consumer so desires.

SUMMARY OF THE INVENTION

The invention disclosed in this application enables consumers to carry multiple drinks within the same bottle thus eliminating the need for consumers to either carry multiple bottles or compromise and carry one type of beverage or another.

The invention disclosed relates to beverage containers made of glass, plastic and other materials that have been manufactured with multiple compartments to store and deliver a variety of beverages and other contents. The disclosed invention includes a cap with multiple partitions where each cap partition includes a valve for controlling flow of beverages or other fluid content stored in the container through that cap partition.

The invention disclosed enables the contents of each compartment of the beverage container to be dispensed separately under the control of a valve located on the cap of the container. The beverages or contents may also be mixed at the time of dispensing by if multiple of a plurality of valves on the cap are engaged simultaneously. The consumer thus has the choice to enjoy a mixture of beverages stored in the disclosed container.

The disclosed invention enables the user of the disclosed beverage container to use the same container to store water and soda, for example, of different varieties of sodas or other beverages. The cap includes multiple orifices or apertures with the number of orifices or apertures equal in number to the number of compartments in the disclosed beverage container. The flow of contents through each of the plurality of orifices is controlled by a valve where a separate valve controls the flow through a predetermined orifice. Each of the plurality of valves are shaped to form a single spout assembly of a predetermined size and shape that facilitates the consumption of the beverages by the user of the disclosed container.

In an embodiment of the invention, the container and cap assembly are detachable, where upon fastening the cap assembly on to the container, the cap partitions align with the beverage container compartments. Thereupon, individual valves control the flow of contents from individual compartments of the beverage container. The alignment of the cap partitions and beverage compartments prevents the contents of individual compartments form mixing as they are discharged separately from the corresponding of a plurality of orifices within a single spout attached to the cap assembly.

In an embodiment of the invention, the container and the cap assembly are permanently molded and connected to each other. In an embodiment of the invention, the contents of the beverage container compartments are pressurized. In an embodiment of the invention, contents of the beverage compartments are pre-filled with a beverages. In an embodiment of the invention, contents of the beverage compartments are pre-filled with a soda. In an embodiment of the invention, contents of the beverage compartments are pre-filled with water. In an embodiment of the invention, contents of the beverage compartments are pre-filled with an assortment of water, soda, juices, sports drinks, or other beverages.

The present invention addresses the need for a beverage container that has the ability to store and discharge liquids separately, sanitarily and safely, as well as allow the user to have the liquids simultaneously discharge from a subset of or from all, the compartments.

The invention disclosed addresses the need to make the beverage container have the shape of a dumbbell, or a weight, that the user can carry easily while user is exercising, including but not limited to walking or jogging, or using any of a variety of indoor sports and work out equipment.

Alternatively, the disclosed invention with two beverages is applicable to two or more beverages by use of two or more compartments affixed in a manner similar to a two compartment container.

The invention also includes an ergonomically designed spout for consumption of beverages. The spout is designed to easily fit in the mouth of the user. The spout is split into at least two parts where separate individual valves controls the flow of beverage through individual section of a predetermined section of the split spout. In the design of the spout disclosed, the spout is allows for ergonomic consumption of beverage regardless of whether or not the valve controlling beverage flow through a spout section is open or closed.

Alternatively, in an embodiment of the invention a twist-on cover, or a snap-on cover is placed over the spout. The purpose of the cover is to protect the spout and to maintain it in a state of proper hygiene.

BRIEF DESCRIPTION OF THE DRAWINGS

The invention will be described in conjunction with the attached drawings in which like referenced numerals designate like elements, and wherein.

FIG. 4A is a cross-section of the cap assembly with valve corresponding to one of the orifices in a fully closed position and the other orifice in a fully open position. FIG. 4B is a cross-section view of the cap assembly with valves corresponding to both the orifices in fully closed position. And, FIG. 4C is a cross-section view of the cap assembly with valves corresponding to both the orifices in fully open position;

FIG. 8A depicts a partial isometric view of the orifices depicting the attachment of the communication device from the cap orifice to the cap apertures, FIG. 8B depicts the view with communication devices attached to the orifices and apertures, and FIG. 8C depicts a partial isometric view of valves that control fluid flow through the apertures;

DRAWINGS

Reference Numerals

Valves 1, 2
Valve Apertures 1*a*, 2*a*
Fluid Communication Devices 3, 4
Valve Flow Channels 3*a*, 4*a*
Valve Stopper Members 3*c*, 4*c*
Valve Stopper Support 3*b*, 4*b*
Valve Scaffold Beam 5
Orifices 6*a*, 6*c*
Cap Assembly Basal Member 6
Beverage Compartments 7, 8
Compartment Inner Wall 7*b*, 8*b*
Compartment and Cap Outer Wall 7*c*, 8*c*
Cap Protective Cover 9
Insignia 10
Embodiments of Invention 100, 200, 300, 400
Embodiments of Cap Assembly 20, 30, 40

DETAILED DESCRIPTION

The invention disclosed allows the consumer to carry and consume two completely different beverages in one convenient container. The consumer can carry a low calorie sports drink with electrolytes, along with plain or spring water in the same container or bottle. The container or bottle disclosed is designed to hold two or more separate beverages each within their own separate compartment such that the beverages held in each compartment do no mix with each other. An embodiment of the invention includes a cap apparatus that includes a plurality of apertures each of which are under the control of a valve and designed to dispense contents of a predefined compartment.

In an embodiment of the invention, two 'half' bottles fused together thereby creating a container by fusing each side separately and assuring that neither of the beverages will not mix. A 'half' bottle is defined as bottle created by taking section of a conventional bottle where the section is taken passing an infinite plane containing the vertical axis of the conventional bottle.

The disclosed cap design enables the consumer to choose which of the two beverages stored they would like to consume. The disclosed cap has two individual valves, each valve engaged to dispense the beverages from the 'half' bottle below. Therefore, if one valve is pulled open the beverage in the corresponding 'half' bottle is dispensed. If the valve on the opposing half is pulled open, the beverage on the opposite side is dispensed. If both valves are simultaneously pulled open, beverages from both 'half' bottles are simultaneously dispensed letting the consumer enjoy a combination of fruit juices or sodas. When both valves of the cap are pushed closed, the cap will be closed and the beverages contained in the container are prevented from dispensing.

Figure 1:
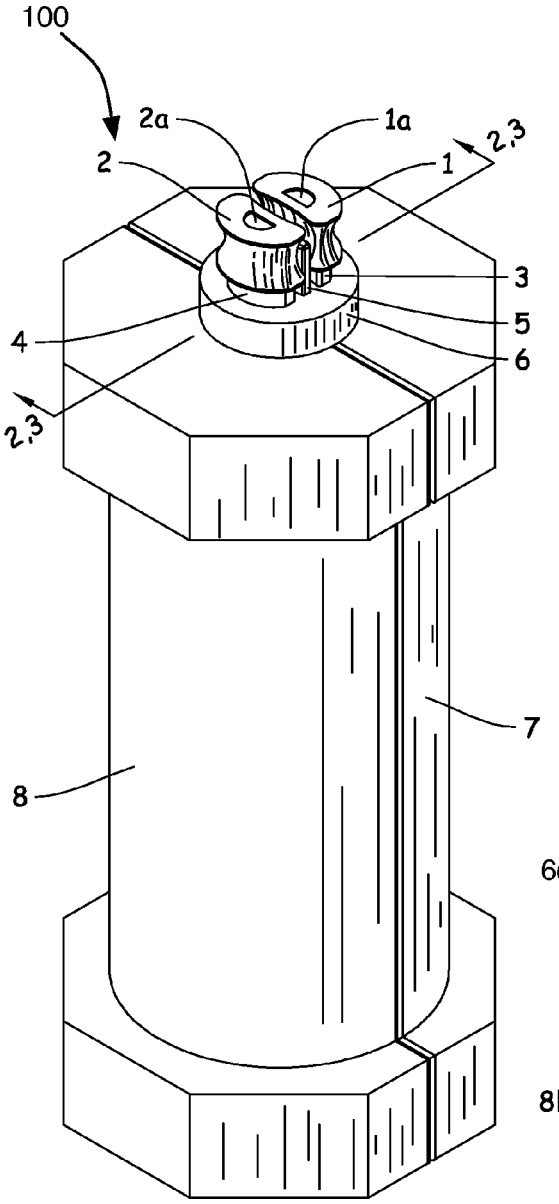
FIG. 1 is an isometric view of the beverage container and the cap in accordance with an embodiment of the invention.
Figure 2:
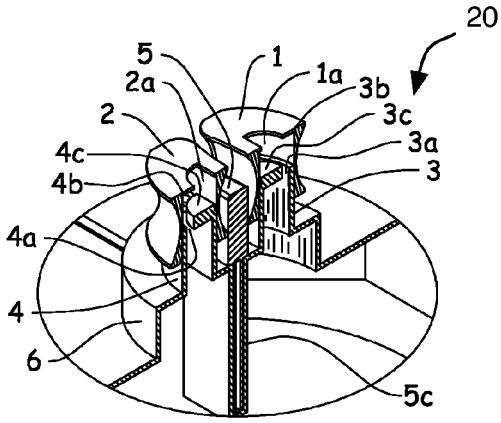
FIG. 2 is a cross sectional partial perspective of the cap assembly for the beverage container shown in FIG. 1 taken across line 2-2.
Figure 3:
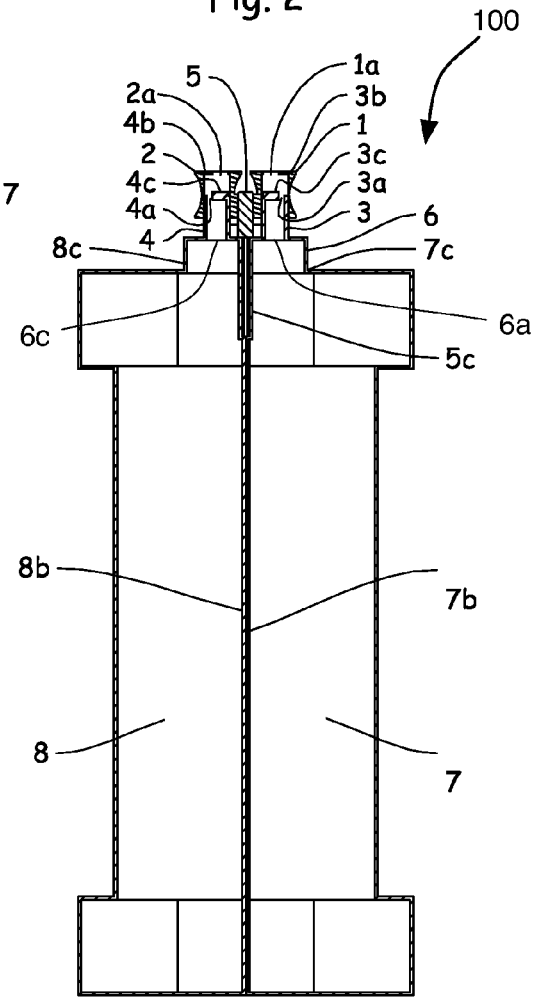
FIG. 3 is a cross sectional view of the embodiment of the beverage container and cap shown in FIG. 1 taken across line 3-3.

In an embodiment 100 of the invention shown in FIGS. 1, 2 and 3, the beverage container body portion comprises of two compartments 7 and 8 used for storing beverages. The beverages are maintained in their own distinct compartments and separated by walls 7*b* and 8*b*. In an embodiment of the invention, the beverage compartment walls 7*b* and 8*b* and the cap apparatus 20 for the plurality of compartments of the body portion include an insulation apparatus 16 that prevents heat exchange with the environment and helps maintain temperature of beverages stored in the body portion of the container. The beverage container is secured to the cap assembly 20 with a fastener 6 serving as the basal point of attachment where the cap assembly 20 is secured to the beverage container.

In an embodiment 100 of the invention, the cap assembly 20 includes fluid communication devices 3 and 4 such that upon securing the base 6 of the cap assembly 20 to the beverage container, compartment 7 and compartment 8 are respectively aligned with the fluid communication devices 3 and 4. Further, upon securing the fastener 6 to the beverage container, the contents of compartment 7 are prevented from flowing through communication device 4 and the contents of compartment 8 are prevented from flowing through communication device 3 by the action the partitioning walls 5*b* and internal barrier 5 which comes into alignment with internal walls 7*b* and 8*b*.

A detailed sectional perspective of the cap assembly 20 for an embodiment of the invention 100 with two compartments is illustrated in FIG. 2. The cap base assembly is includes fluid communication devices 3 and 4, and a partitioning wall 5 with a catcher 5*b* to prevent valves 1 and 2 from sliding out. The walls of valves 1 and 2 respectively have cut-outs 1*a* and 2*a* which have a complementary stoppers 3*c* and 4*c* fixedly connected to the inside barrier wall 5.

As illustrated in FIG. 3, communication devices 3 and 4 are used to connect orifices 6*a* and 6*b* respectively in the cap assembly 20 to apertures 1*a* and 2*a*. Fluid flow through the communication devices 3 and 4 is controlled by valves 1 and 2 respectively. Valve members 3*c* and 4*c* are complementary in size and shape to valve apertures 1*a* and 2*a* respectively. Therefore, when the valves are engaged to restrict fluid flow through the fluid communication devices 3 and 4, the valve members 3*c* and 4*c* fully occupy apertures 1*a* and 2*a* respectively and create a water tight seal thereby preventing the flow of fluid across the associated fluid communication devices. Contrarily, when the valves are disengaged to fluid flows through channels 3*a* and 4*a* of the fluid communication devices 3 and 4 and reaches apertures 1*a* and 2*a* respectively.

Figure 4A:
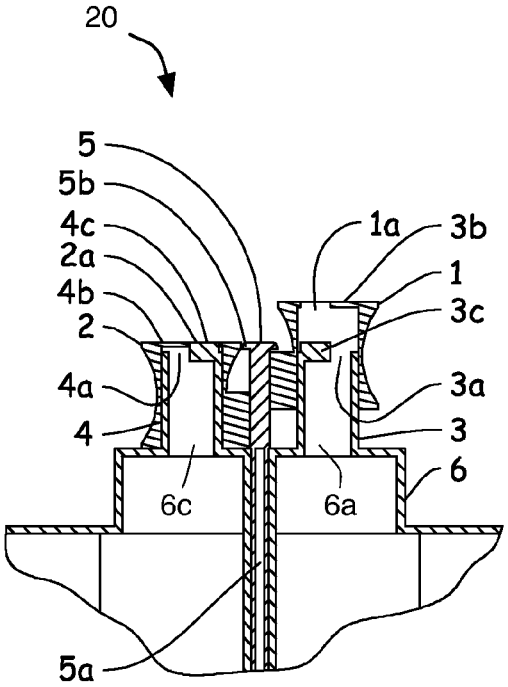
FIGS. 4A, 4B and 4C are cross-sectional views of an embodiment of the cap assembly with two valves shown in FIG. 5.
Figure 4B:
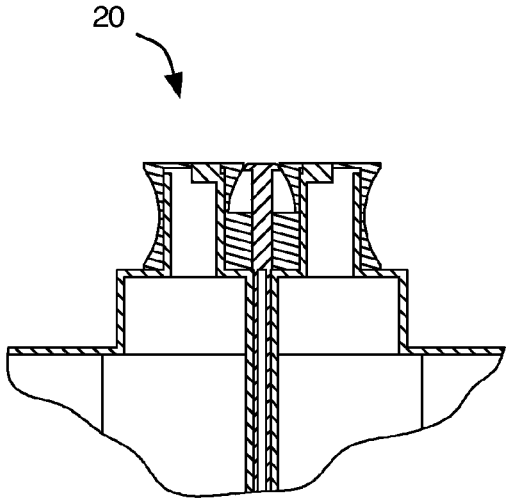
Figure 4C:
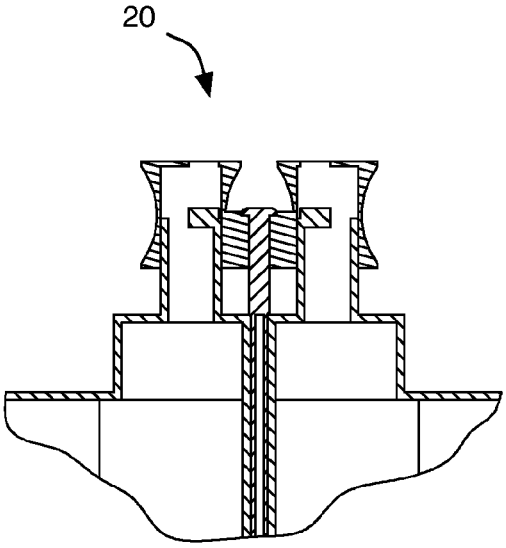
Figure 5:
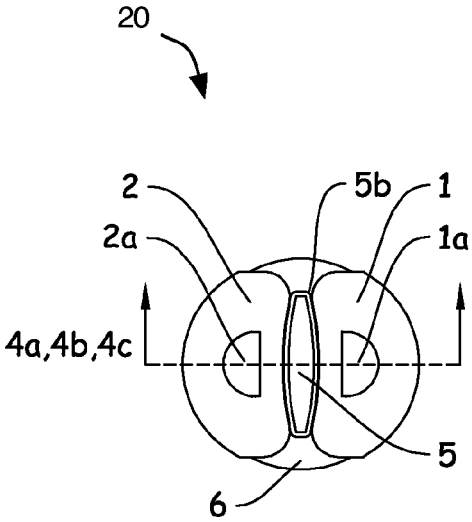
FIG. 5 is the plan view of the cap assembly in an embodiment of the beverage container with two compartments.

FIGS. 4A, 4B, and 4C are cross-sectional views of an embodiment of the cap assembly 20 illustrated in FIG. 5. FIG. 4A illustrates one valve 1 in an open configuration and valve 2 in a closed configuration. In the closed configuration for valve 2, aperture 2*a* and stoppers 4*c* come together to completely close aperture 2*a*. FIG. 4B illustrates a configuration of the cap assembly 20 with both valves engaged where apertures 1*a* and 2*a* in conjunction with stoppers 3*c* and 4*c* form a water tight seal preventing flow of any beverages. In FIG. 4C illustrates a configuration of the cap assembly 20 with both valves 1 and 2 disengaged to form an in an open configuration allowing a free flow of beverages from beverage compartments 7 and 8 respectively where the fluid flow passes through the orifice 6*a* and 6*c*, through the communication devices 3 and 4, and through valve channels 3*a* and 4*a*, finally reaching and dispensing through the apertures 1*a* and 2*a* respectively.

Figure 6:
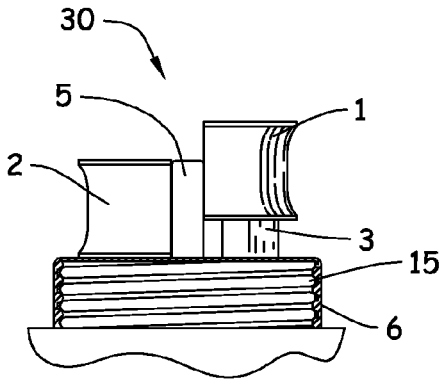
FIG. 6 is a partial cross-sectional view of an embodiment of the cap assembly with two orifices.

FIG. 6 is a cross-sectional view of an embodiment of the cap assembly 30 designed to dispense two beverages. The cap assembly 30 in the embodiment shown includes valves 1 and 2 that are separated with a dual purpose beam 5 wherein the first purpose of the beam 5 of a predetermined width is to provide a scaffolding support for the movement of valves 1 and 2 and its second purpose is to separate the valves 1 and 2 by a predetermined amount.

Figure 7:
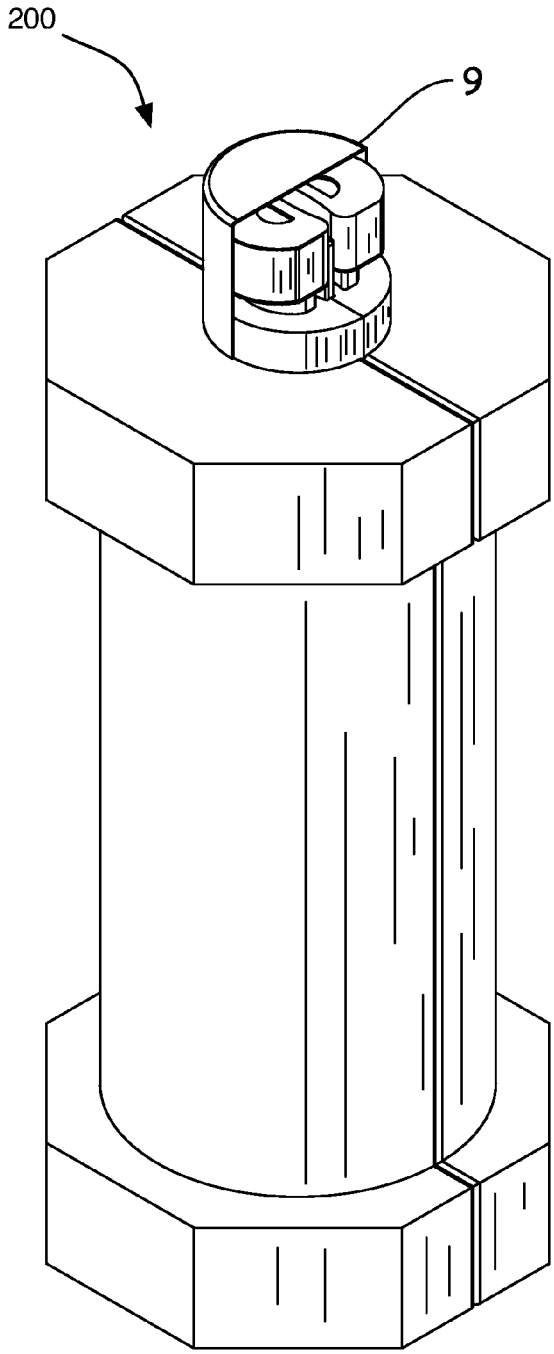
FIG. 7 is an isometric view of an embodiment of the invention with two compartment and a protective cover for the cap assembly. The protective cover shown is partially cut out to show hidden members of the cap assembly.

FIG. 7 is an isometric view of the invention where the cap assembly includes a cap-assembly cover 9 for the cap assembly shown in FIG. 6. Any and all embodiments of the invention may or may not contain a cap assembly cover 9. The purpose of the cap assembly cover 9 is to prevent accidental discharge of beverages from the container, to maintain beverages under a predefined pressure, to protect the assembly from wear and tear, to maintain proper hygiene, and to serve any other conventional function or functions of a bottle or a beverage container cap. In an embodiment of the invention, the cap assembly cover 9 is made with transparent material, such as a transparent plastic or polymer suitable for covering the cap assembly as well as letting the users view the dual flow apertures included on the cap assemblies 20, 30, 40, or equivalents thereof.

Figure 8A:
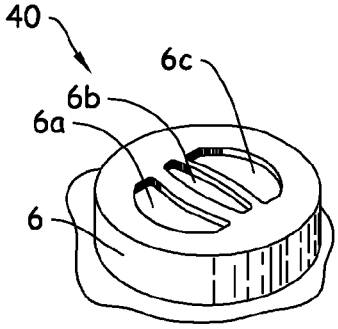
FIGS. 8A, 8B and 8C depict the isometric views of the components of an embodiment of the cap assembly.
Figure 8B:
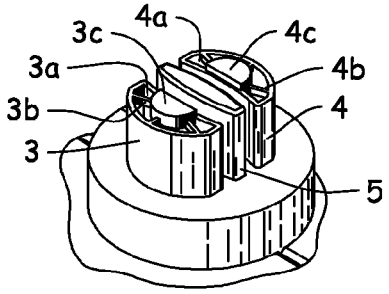
Figure 8C:
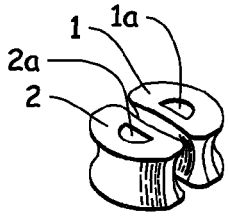

FIGS. 8A, 8B and 8C depict an isometric view of the components of cap assembly 40 designed for an embodiment of the invention with two beverage compartments. FIG. 8A illustrates the lower portion of the cap assembly depicting orifices regions 6*a* and 6*c* which are complementary in size and shape to the fluid communication devices 3 and 4 shown in FIG. 8B. In an embodiment of the invention, upon the insertion and fastening of fluid communication devices 3 and 4 into the orifices 6*a* and 6*c* respectively, a water-tight seal is created between the basal portion 6 of the cap assembly 40 and the fluid communication devices 3 and 4 respectively. In an embodiment of the invention, the seal created by insertion of the fluid communication devices 3 and 4 into orifices 6*a* and 6*c* respectively is further able to withstand a predetermined vapor pressure that beverages stored in compartments 7 and 8 are required to maintain.

As illustrated in FIG. 8A, the cap assembly 40 also includes a beam 5 inserted into the cavity 6*b* on the basal portion 6. Beam 5 serves as a scaffolding and support member to facilitate the movement of valves 1 and 2. Valves 1 and 2 slide over the fluid communication devices 3 and 4 which include stoppers 3*c* and 4*c* supported by stopper support beams 3*b* and 4*b*, as well as fluid communication channels 3*a* and 4*a* respectively. Valves 1 and 2 are engaged by depressing them until the stoppers 3*c* and 4*c* comply occupy apertures 1*a* and 2*a* respectively thereby creating a water tight seal and preventing flow fluid flow. In an embodiment of the invention, the seal created by engaging the stoppers 3*c* and 4*c* into the apertures 1*a* and 2*a* respectively is able to able to withstand a predetermined vapor pressure at beverages stored in compartments 7 and 8 are required to maintain. When the valves are disengaged, he stoppers 3*c* and 4*c* are removed from the apertures 1*a* and 2*a* thus allowing any beverages stored in compartments 7 and 8 to communicate through channel 3*a* and 4*a* and dispense through apertures 1*a* and 2*a* respectively.

Figure 9:
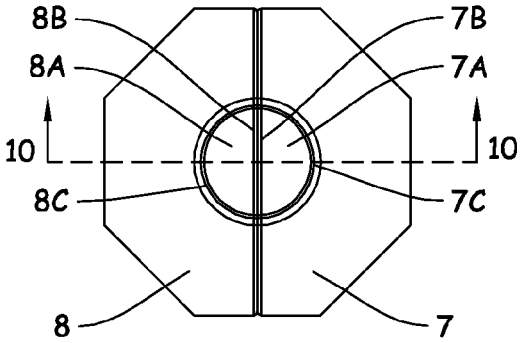
FIG. 9 is a top plan view of the body portion of an embodiment of the invention with two compartments shown in FIG. 10.
Figure 10:
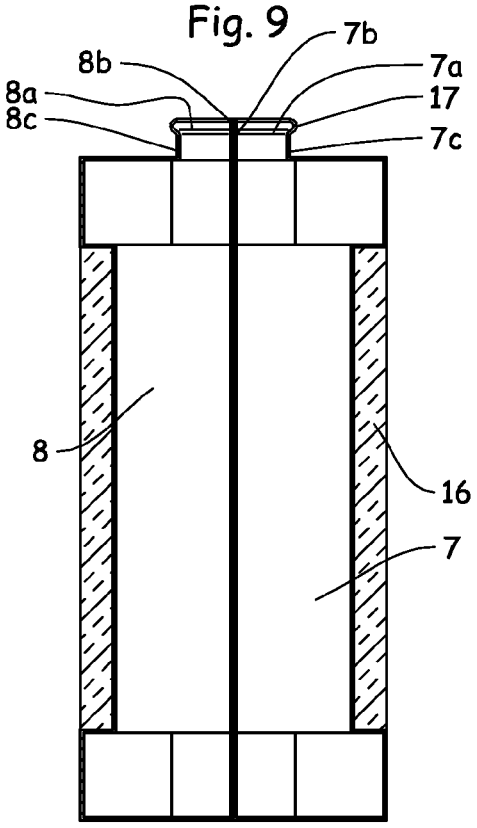
FIG. 10 is a side elevational view of the body portion of an embodiment of the invention with two compartments.

FIG. 9 is a top plan view and FIG. 10 is a side elevational view of the body portion of an embodiment of the invention with two beverage storing compartments. Container openings 7*a* and 8*a* together form the neck portion of an embodiment of the beverage container and allow discharge of beverages from individual compartments 7 and 8 respectively. In an embodiment of the invention, basal component 6 of the cap assembly is fastened to the surfaces 7*c* and 8*c* using a an attachment device.

In an embodiment of the invention, the neck portion is fastened to basal cap 6 member using a threading mechanism where threads on neck portion 15 of the body portion complementary to the threads on cap portion and secured to the cap portion neck portion through an engagement of complementary threads on the cap portion and the threads on the neck portion. In an embodiment of the invention, the neck portion is fastened to basal cap member 6 where the cap portion includes a male lip portion 17, and the neck portion of the body portion includes a female lip receptor where the female lip receptor is complementary to the male lip portion, and the cap portion is secured to neck portion through insertion of the male lip portion into the female lip receptor.

Figure 11:
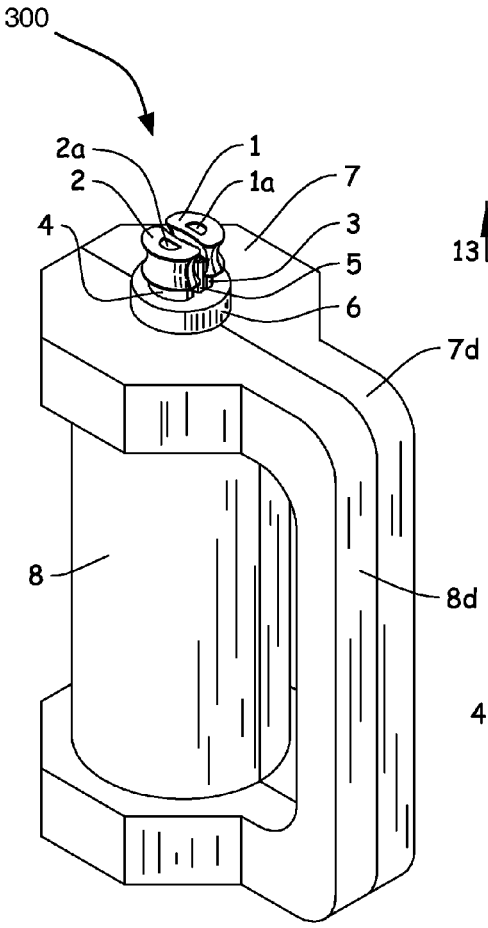
FIG. 11 is an isometric view of an embodiment of the invention where the body portion contains two compartment and the body portion includes a handle.
Figure 12:
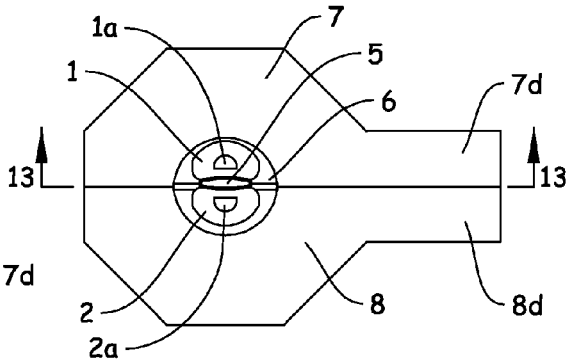
FIG. 12 is a top plan view of an embodiment of the invention shown in FIG. 11.
Figure 13:
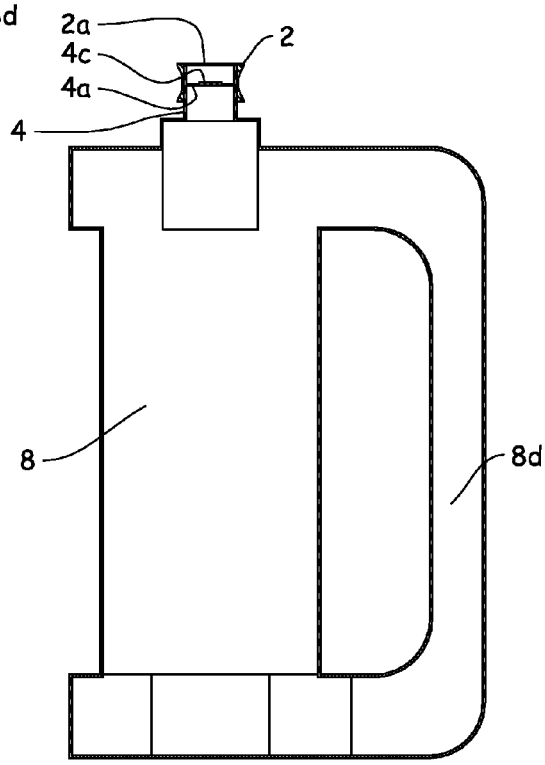
FIG. 13 is a side elevational view of an embodiment of the invention shown in FIG. 11.

In an embodiment of the invention shown in FIGS. 11, 12 and 13, the beverage container includes a handle for facilitating users in carrying the container. FIG. 11 is an isometric view of the embodiment 300, FIG. 12 is a top plan view, and FIG. 13 is a side elevational plan view of the invention. In an embodiment of the invention, the inside container surfaces of handle portions 7*d* and 8*d* and the inside surfaces of the compartments 7 and 8 respectively form a continuous surface such that the storing capacity of containers 7 and 8 is augmented by the storing capacity of handle portions 7*d* and 8*d* respectively.

Figure 14:
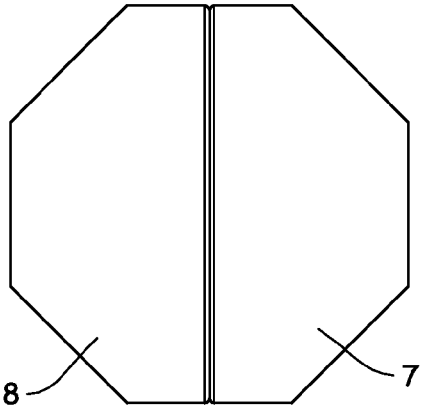
FIG. 14 is a bottom plan view of an embodiment of the invention shown in FIG. 1.

FIG. 14 is a bottom plan view of an embodiment 100, and embodiment 200 of the invention shown in FIGS. 1 and 7 respectively.

Figure 15:
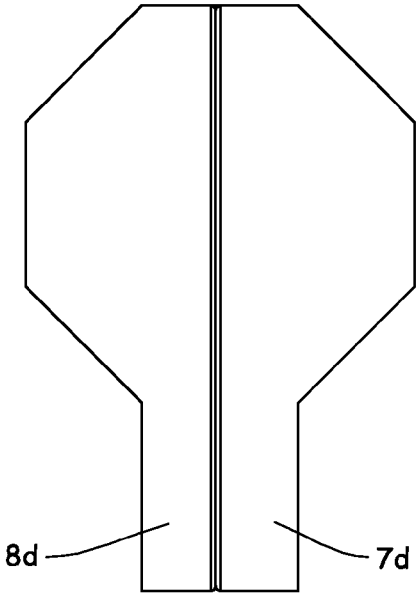
FIG. 15 is a bottom plan view of an embodiment of the invention shown in FIG. 11.

FIG. 15 is a bottom plan view of an embodiment 300 of the invention shown in FIG. 11.

Figure 16:
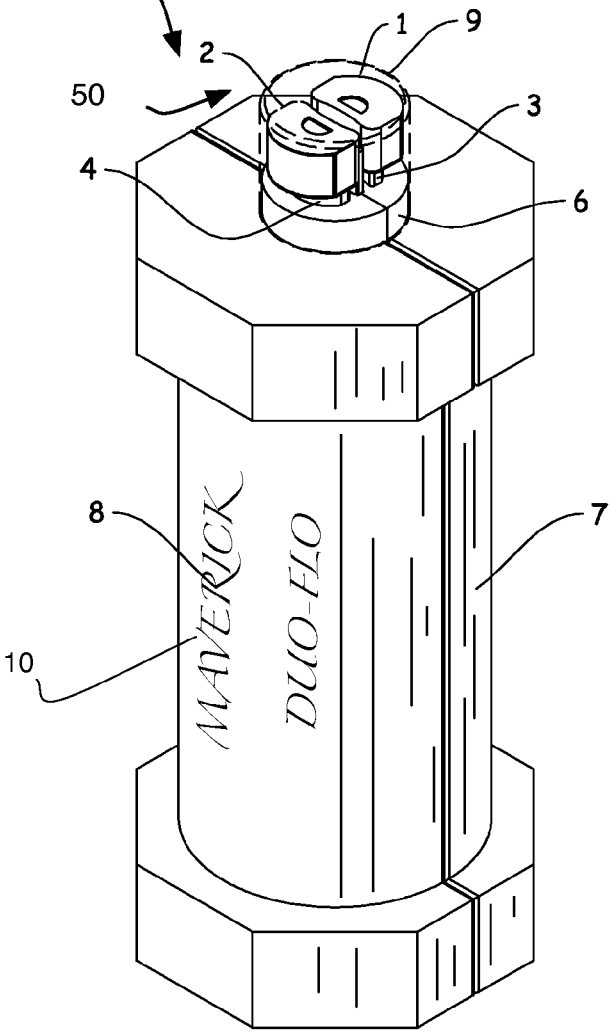
FIG. 16 is an isometric view of an embodiment of the invention where the cap assembly is moulded with the container section to store pressurized beverages, the body portion exhibits and insignia, and the cap assembly includes a transparent protective cover.

FIG. 16 is an isometric view of an embodiment 400 of the invention where the cap 6 and the cap assembly 50 are molded to the neck portion of the body of the body portion of the invention. In an embodiment of the invention the bottle and cap sections are formed through material such as high pressure withstanding plastics or polymers. In an embodiment of the invention container and cap assembly as well as the fastened protective cover 9 are able withstand a predetermined vapor pressure as needed in storage of carbonated beverages, soda beverages, and other pressurized beverages. In an embodiment of the invention, a bottle cover 9 is included cover valve 1 and 2 such that the bottle cover 9 is attached to the cap assembly. The attachment of the bottle cover 9 to the cap assembly is designed to withstand a predetermined vapor pressure as needed in storage of carbonated soda beverages and other pressurized beverages. In an embodiment of the invention, the bottle cover 9 is made with transparent or otherwise display the dual aperture based drinking spout included in the cap assembly 50. In an embodiment of the invention, the surface of the beverage container displays plurality of insignia 10 such as to identifying the source of the beverage or otherwise providing information for the functional uses of the container.

Embodiments 100, or 200, or 300, or 400, or equivalents thereof are designed to form in the shape of a dumbbell. The dumbbell has utility in that is provides a higher degree of stability to the beverage container and allows it to lay stably laterally resting on the two dumbbells, as well as axially as resting on the dumbbell without the attached cap assembly.

Embodiments 100, or 200, or 300, or 400, or equivalents are further be build with material with included predetermined weight training apparatus attached to the dumbbell sections. Thereby, the disclosed beverage container has the utility to serve as exercise equipment or accruement thereof.

In an embodiment of the invention, materials including plastics are used for constructing the beverage container and cap assembly. In an embodiment of the invention, materials including steel or aluminum, is used for constructing the beverage container and cap assembly. In an embodiment of the invention, the container is build with double walled steel or metal to enable it to serve as an exercise equipment and provide better insulation and maintain the temperature of the beverages stored therein.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the embodiments of the invention without departing from the spirit and scope of the appended claims.

I claim:

1. A compartmented container and cap, comprising:

a body portion partitioned into a plurality of compartments wherein each of the plurality of compartments has a hollow interior portion that provides for beverage storage therein, and has an opening;

a neck portion wherein each of the plurality of compartments is in communication with the neck portion, the neck portion having predetermined dimension to accommodate all of the openings of the plurality of body compartments;

a cap assembly having a plurality of valve assemblies equal in number to the number of body compartments where each of the valve assemblies includes a substantially cylindrical hollow channel housing having a first end and a second end where the hollow portion of the channel housing forms an orifice adapted to allow a flow of liquid, and the first end of the channel housing includes a stopper member, a substantially cylindrical sleeve having an inner surface and an outer surface and having a first end and a second end and where the inner surface of the cylindrical sleeve is adapted to slide over the channel housing, the first end of the cylindrical sleeve includes a stopper support fixedly attached to the inner surface and shaped to complement the channel stopper member whereby a seal is formed when the stopper member and stopper support are juxtaposed, and the second end of the cylindrical sleeve includes a slide bearing fixedly attached to the outer surface of the cylindrical sleeve, a valve scaffold beam including a first end and a second end where the first end includes a flange adapted to stop a sliding movement of the cylindrical sleeve by engaging the slide bearing, and the second end attached the neck portion;

an attachment device securing the cap assembly to the neck portion wherein the attachment of the cap assembly to the neck portion creates a water tight seal between the cap assembly and the cap portion, align the body compartments with an associated valve assembly, and contents within the body compartment can flow through the orifice in the associated valve assembly.

2. A compartmented container and cap of claim 1, wherein the body portion comprises two compartments and the cap portion comprises two partitions.

3. A compartmented container and cap of claim 1, wherein the body portion is shaped like a dumbbell and includes a narrow portion having a first and a second end wherein the dimension of the narrow portion is adapted to support a human grip; and a first and a second wider portion wherein the first end of the narrow portion is connected to a first wider portion and the second end of the narrow portion is connected to the second wider portion.

4. A compartmented container and cap of claim 1, where the body portion including the plurality of compartments are made with material having a weight whereby the compartmented container is used as a weight for exercise or as a work-out apparatus.

5. A compartmented container and cap of claim 1, wherein the opening in the neck portion of the body portion includes a circumference to accommodate and allow a cleaning apparatus to pass through.

6. A compartmented container and cap of claim 1, wherein the attachment devices includes the cap assembly includes threads;

the neck portion having threads where the threads on the neck portion are complementary to the threads on cap assembly; and the cap assembly is secured to the neck portion through an engagement of complementary threads on the cap assembly and the threads on the neck portion.

7. A compartmented container and cap of claim 1, wherein the attachment device includes the cap assembly includes a male lip portion;

the neck portion includes a female lip receptor where the female lip receptor is complementary to the male lip portion; and the cap assembly is secured to neck portion through insertion of by inserting the male lip portion into the female lip receptor.

8. A compartmented container and cap of claim 1, wherein the attachment device includes the cap portion that is permanently molded to neck portion of the body portion.

9. A compartmented container and cap of claim 1, wherein the body portion, the cap portion, and the attachment device are of with a strength that can withstand pressure of contents stored in the plurality of compartments of the body portion.

10. A compartmented container and cap of claim 1, wherein the plurality of compartments of the body portion include an insulation apparatus.

11. A compartmented container and cap of claim 1, wherein the cap assembly or the body portion includes an indicia or mark.

12. A compartmented container and cap of claim 1, wherein the cap assembly includes a protective cover; and a cover attachment device to detachably secure the protective cover over the cap assembly.

13. A compartmented container and cap, comprising:

a body portion partitioned into a plurality of compartments wherein each of the plurality of compartments has a hollow interior portion that provides for beverage storage therein, and has an opening;

a handle portion having a shape adapted to complement a human grip wherein the handle portion is connected to the body portion;

a cap assembly having a plurality of valve assemblies equal in number to the number of body compartments where each of the valve assemblies includes a substantially cylindrical hollow channel housing having a first end and a second end where the hollow portion of the channel housing forms an orifice adapted to allow a flow of liquid, and the first end of the channel housing includes a stopper member, a substantially cylindrical sleeve having an inner surface and an outer surface and having a first end and a second end and where the inner surface of the cylindrical sleeve is adapted to slide over the channel housing, the first end of the cylindrical sleeve includes a stopper support fixedly attached to the inner surface and shaped to complement the channel stopper member whereby a seal is formed when the stopper member and stopper support are juxtaposed, and the second end of the cylindrical sleeve includes a slide bearing fixedly attached to the outer surface of the cylindrical sleeve, a valve scaffold beam including a first end and a second end where the first end includes a flange adapted to stop a sliding movement of the cylindrical sleeve by engaging the slide bearing, and the second end attached the neck portion;

an attachment device securing the cap assembly to the neck portion wherein the attachment of the cap assembly to the neck portion creates a water tight seal between the cap assembly and the cap portion, align the body compartments with an associated valve assembly, and contents within the body compartment can flow through the orifice in the associated valve assembly.

14. A compartmented container and cap of claim 13, wherein the handle portion includes a plurality of handle compartments equal in number to the number of body compartments wherein each of the plurality of handle compartments is in fluid communication with an associated body compartment and each of the plurality of handle compartments has a hollow shape with an interior portion that provides for beverage storage therein.

15. A compartmented container and cap of claim 13, wherein the attachment device includes the cap assembly that is permanently molded to the neck portion of the body portion.

16. A compartmented container and cap of claim 13, wherein the body portion, the cap assembly, the handle portion, and the attachment device are of a strength that can withstand the pressure of contents stored in the plurality of compartments of the body portion.

17. A compartmented container and cap of claim 13, wherein the body portion is shaped like a dumbbell and includes a narrow portion having a first and a second end wherein the dimension of the narrow portion is adapted to support a human grip; and a first and a second wider portion wherein the first end of the narrow portion is connected to a first wider portion and the second end of the narrow portion is connected to the second wider portion.

18. A compartmented container and cap of claim 13, where the body portion including the plurality of compartments are made with material having a weight whereby the compartmented container is used as a weight for exercise or as a work-out apparatus.

19. A compartmented container and cap of claim 13, wherein the opening in the neck portion of the body portion includes a circumference to accommodate and allow a a cleaning apparatus to pass through.

20. A compartmented container and cap of claim 13, wherein the plurality of compartments of the body portion and the handle portion include an insulation apparatus.

* * * * *